US006058985A

United States Patent [19]

Petri et al.

[11] Patent Number: 6,058,985

[45] Date of Patent: May 9, 2000

[54] BOTTLING MACHINE WITH A SET-UP TABLE AND A SET-UP TABLE FOR A BOTTLING MACHINE AND A SET-UP TABLE FOR A BOTTLE HANDLING MACHINE

[75] Inventors: Ulrich Petri, Dortmung; Klaus-Werner Jung, Weiterstadt, both of Germany

[73] Assignee: KHS Maschinen- und Anlagenbau Aktiengesellschaft, Dortmund, Germany

[21] Appl. No.: 09/151,845

[22] Filed: Sep. 11, 1998

[30] Foreign Application Priority Data

Sep. 13, 1997 [DE] Germany ..... 197 40 373

[51] Int. Cl.[7] ..... B65B 43/42

[52] U.S. Cl. ..... 141/168; 141/129; 141/135; 141/144; 141/145; 141/163; 198/469.1; 198/475.1; 198/478.1; 198/480.1; 198/481.1

[58] Field of Search ..... 141/2, 129, 135, 141/144, 145, 163, 168; 198/469.1, 475.1, 480.1, 481.1, 478.1

[56] References Cited

U.S. PATENT DOCUMENTS

| | | | |
|---|---|---|---|
| 3,097,672 | 7/1963 | Minard | 141/142 |
| 5,713,180 | 2/1998 | Lewis | 53/253 |
| 5,713,403 | 2/1998 | Clusserath et al. | 141/101 |

*Primary Examiner*—Steven O. Douglas
*Assistant Examiner*—Timothy L. Maust
*Attorney, Agent, or Firm*—Nils H. Ljungman & Associates

[57] ABSTRACT

A set-up table or conveyor system for bottle handling machines with inlet and outlet star wheels and corresponding guide rails for the bottles. The drive mechanisms for the individual star wheels are located below and at a distance from the star wheels. The drive mechanisms and the associated drive shafts are covered by hoods or covers that can extend to the bottle transport level.

14 Claims, 4 Drawing Sheets

BOTTLING MACHINE WITH A SET-UP TABLE AND A SET-UP TABLE FOR A BOTTLING MACHINE AND A SET-UP TABLE FOR A BOTTLE HANDLING MACHINE

BACKGROUND OF THE INVENTION

1. Field of the Invention

The present invention relates to a setup table or conveyor belt for bottle handling machines with inlet and outlet stars or star wheels and corresponding guide rails for the bottles. The set-up table also has drive devices for individual stars and handling stations, and a carrier plate that covers, conceals or protects the drive devices.

2. Background Information

Setup tables or conveyors of the type described above are used on bottle handling machines upstream of the large handling rotating body itself, which has a plurality of circular handling spaces located next to one another for the individual bottles. For the delivery and removal of the bottles, such a setup table has a lead-in conveyor or worm gear that is used to establish a separation distance that corresponds to the spacing of the handling spaces of the rotating body. The lead-in conveyor then delivers the bottles at the correct intervals into circulating intermediate stars which in turn transfer the bottles to the handling spaces. Corresponding transfer stars are provided in the outlet-side portion of the rotating body to extract and transport the bottles away from the handling machine after the bottles have passed through the handling machine.

In the vicinity of this setup table there can be additional treatment stations, e.g. closing machines, labelling machines etc. On account of the high speed of processing, in particular in this area as a whole, there are frequently residual glass fragments or fluids, which means that a corresponding periodic cleaning of the machine is necessary.

OBJECT OF THE INVENTION

The object of the present invention is therefore to redesign the setup table, in particular from a hygienic point of view, so that corners and other structures that can collect dirt are minimized as far as possible, and the result is a collection of machines that are easy to clean.

SUMMARY OF THE INVENTION

The present invention teaches that this object can be achieved by a setup table of the type described above in which, in the vicinity of the bottle transport level, i.e. the level at which the bottles are carried, the setup table includes only the necessary bottle transport and bottle guidance devices. The drive devices can be located below and at some significant or substantial distance from the bottle transport level. These drive devices can also be covered by hood-like structures, and the drive shafts for the drive devices can be surrounded by columns and/or tower-like housings that can extend to the bottle transport level.

In at least one embodiment of the present invention, the present invention teaches that the individual stars and transport devices can be operated by shafts that are driven on their bottom ends, and these shafts can be surrounded by columns that begin above the drive base plate.

The present invention also teaches that the edge of the carrier plate can essentially follow the contour of the drive devices corresponding to one another.

This realization represents a particularly advantageous hygienic configuration of the invention which can easily be kept substantially free of any dirty corners etc. Almost any residual glass fragments can be substantially immediately deflected and removed upstream of the rotary handling body.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is described in greater detail below, with reference to the embodiments illustrated in the accompanying drawings, wherein.

DESCRIPTION OF THE PREFERRED EMBODIMENT

Figure 1:
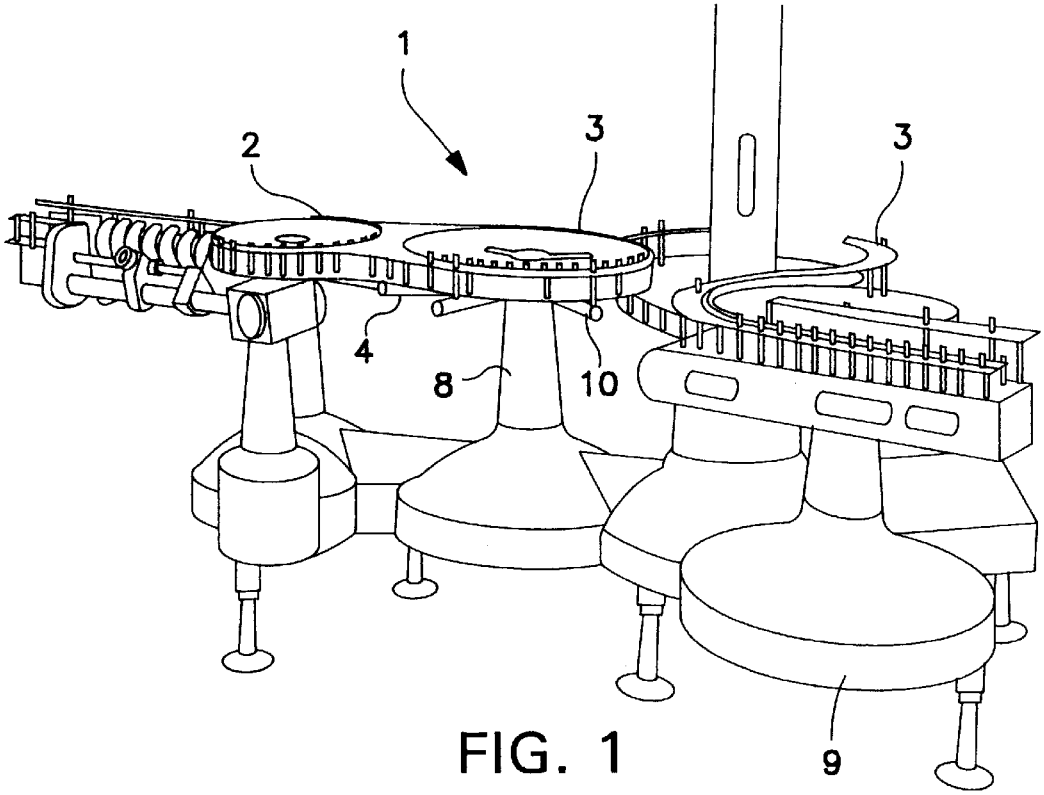
FIG. 1 shows the front side of an embodiment of the setup table.
Figure 2:
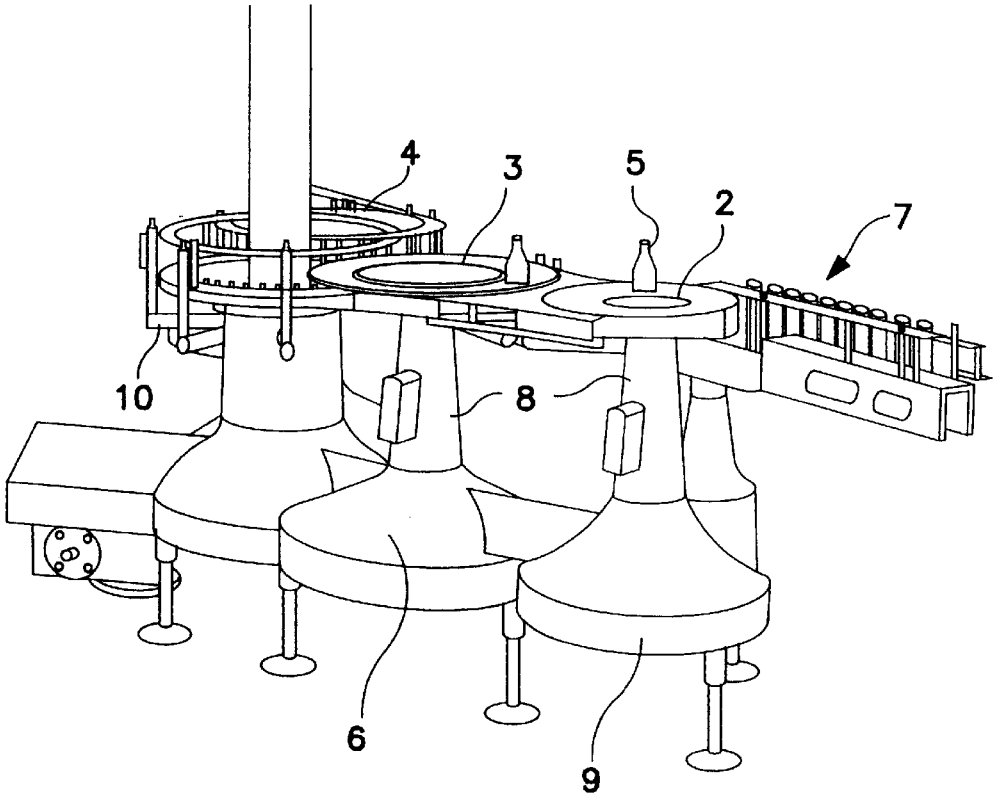
FIG. 2 shows the side of an embodiment of the setup table facing the rotary handling body.
Figure 4:
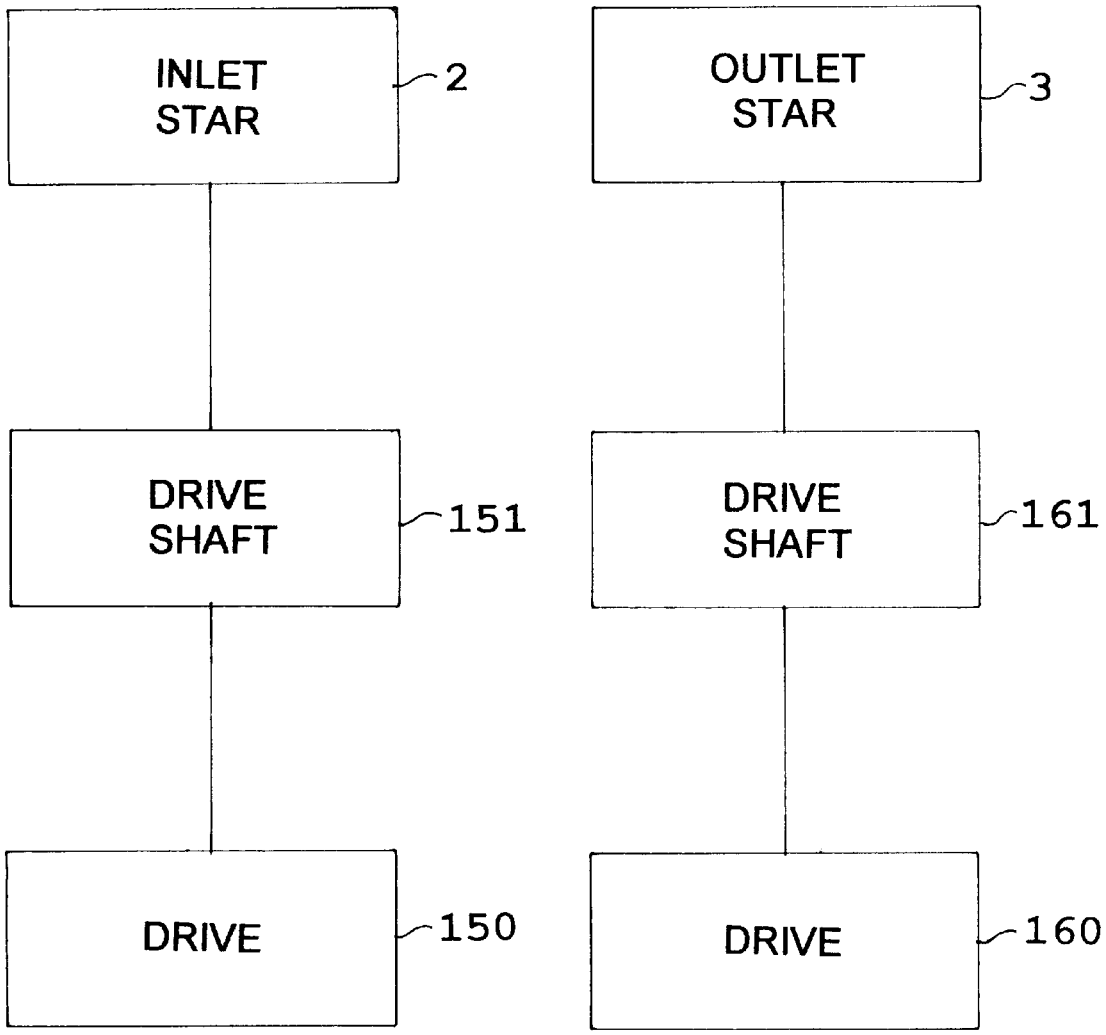
FIG. 4 is a block representation of drive systems for the inlet and outlet stars.

As illustrated in FIGS. 1 and 2, the setup table 1 comprises an inlet star or star wheel 2 and an outlet star or star wheel 3 and correspondingly oriented guide tracks 4 for the bottle 5. There are also drive devices 150, 160 (see FIG. 4) for the individual stars 2, 3 and handling stations. The drive devices 150, 160 are covered by a carrier plate 6 or multiple carrier plates.

In the vicinity of the bottle transport level 7, i.e. in the vicinity of the plane in which the transport of the bottles occurs, the setup table 1 comprises substantially only the required bottle transport and bottle guidance devices. The drive devices 150, 160 themselves can be located underneath this level 7, at a significant distance from the level 7.

For this purpose, the carrier plate 6 is realized in the form of a hood and is equipped with additional columns or tower-like housings 8 that extend upward, through which columns 8 the respective drive shafts 151, 161 (see FIG. 4) for the inlet and outlet stars 2, 3 extend upward. The outer edge of the carrier plate 6 itself preferably follows the contours of the drive devices 150, 160 that correspond to one another. These drive devices 150, 160 can comprise, for example, gear wheels or similar mechanisms that mesh with one another. The upwardly pointing columns 8 are connected to the carrier plate 6 in a sealed manner. The columns 8 can have a slight conical taper toward the top. The columns 8 can also be realized in the shape of a truncated cone or a truncated pyramid. As illustrated, the carrier plate 6 has a smaller vertical section 9 and is also realized with a diagonal and/or curved edge ascending to the lower edge of the respective columns 8. The carrier plate 6 can be realized in the form of a cast or welded body. In the upper portion, the columns 8 can have support arms 10 pointing outward in a star-shape for the respective transport and bottle guidance devices.

Figure 1A:
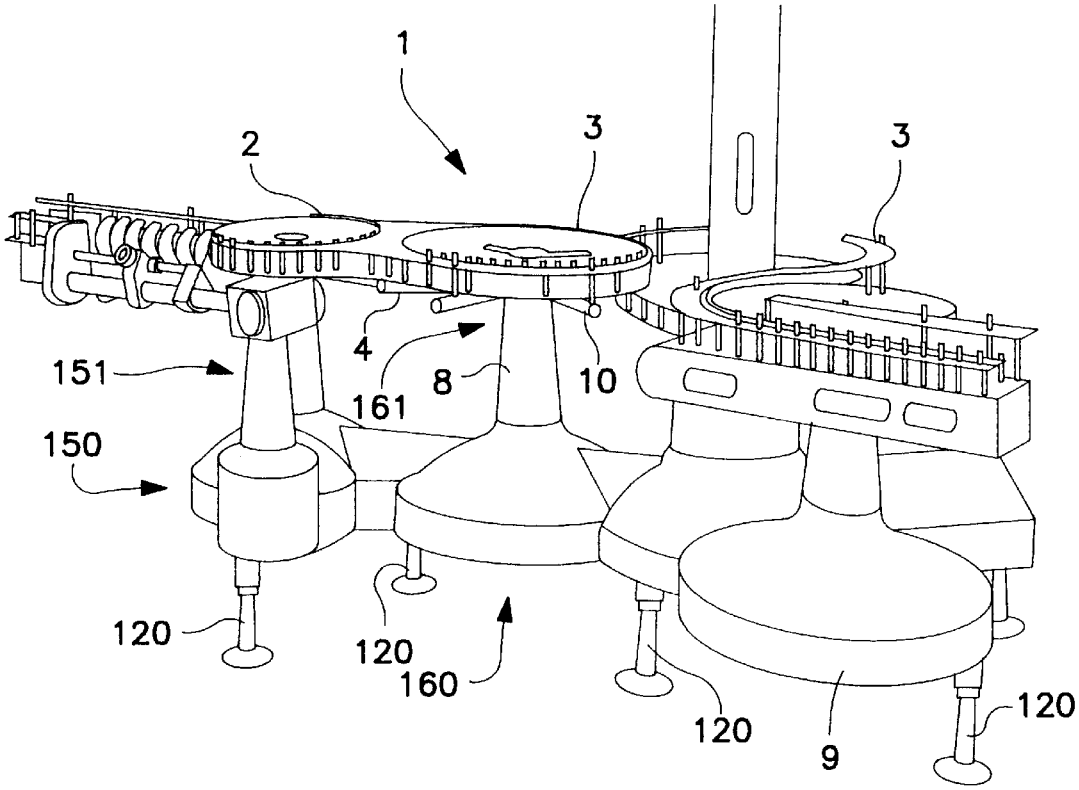
FIG. 1A shows additional detail of the view in FIG. 1.
Figure 2A:
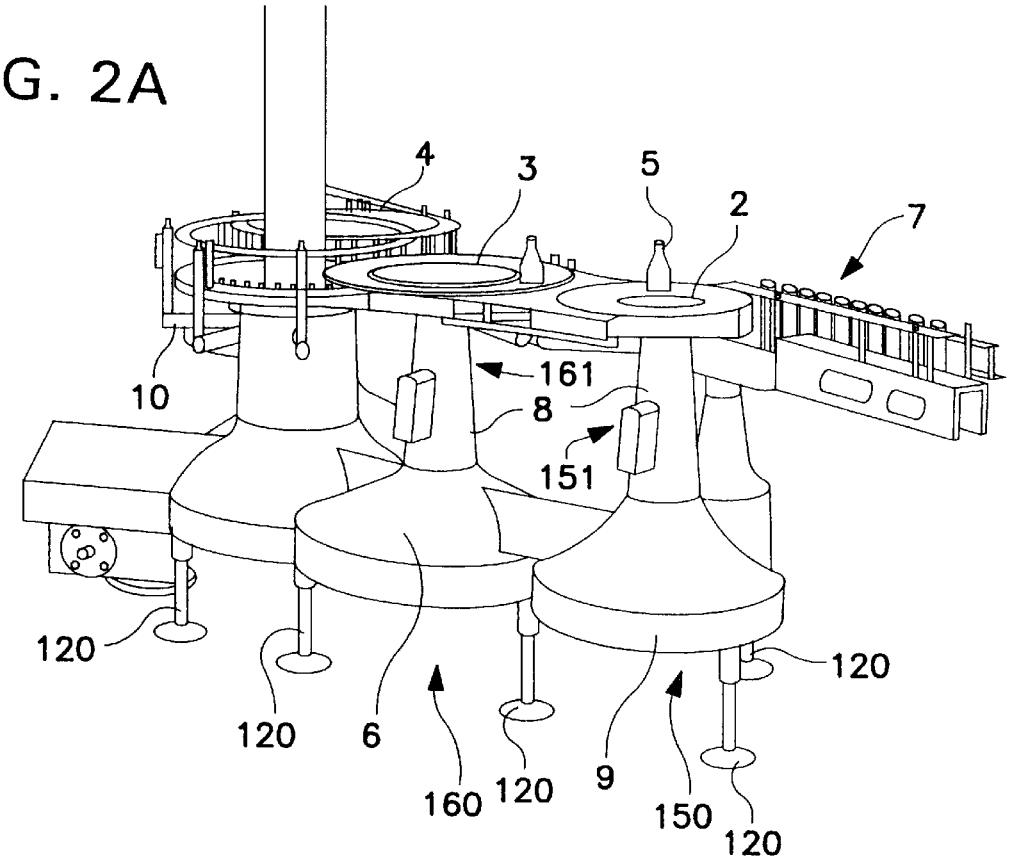
FIG. 2A shows additional detail of the view in FIG. 2.

FIGS. 1A and 2A show additional details of at least one embodiment of the present invention. Legs or floor contacting structures 120 are provided on the carrier plate or cover or housing 6 which legs 120 support the carrier plate 6 from the floor. Drive shafts 151, 161 can be located under the columns 8 of the carrier plate 6. Drive mechanisms 150, 160 can be located under the carrier plate 6.

Figure 3:
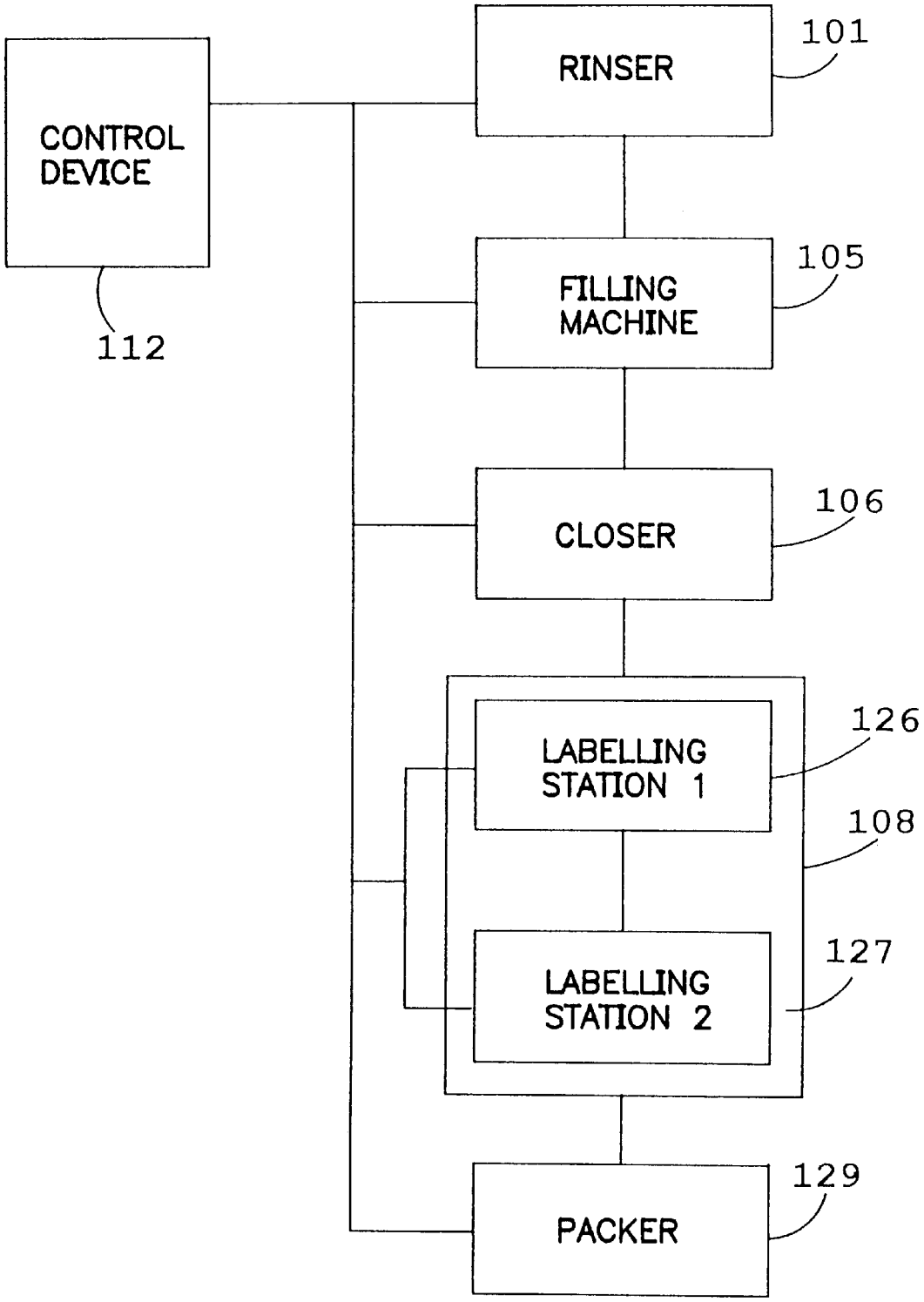
FIG. 3 is a block representation of the functioning of a control device in regard to one possible embodiment of the present invention.

FIG. 3 is a block representation of one possible embodiment of a bottling system.

Specifically, FIG. 3 shows a rinser 101, to which rinser 101 the containers, in at least one embodiment of the present invention bottles, are fed and downstream of which rinser 101, in the direction of travel, the rinsed bottles are transported by means of a conveyor line which can be formed by a star wheel conveyor to a filling machine 105 or its inlet star wheel or set-up table.

Downstream of the filling machine 105, in the direction of travel of the bottles, there can preferably be a closer 106 which closes the bottles after the bottles have been filled in the filling machine 105. The closer 106 can be connected directly to a labelling device 108 by means of a conveyor line formed by a plurality of star wheel conveyors.

The rinser 101, the filling machine 105 and the closer 106 can form a common block of machines which has a common bottling table or set-up table.

The labelling device 108 can have, for example, two individual labelling stations or units 126 and 127 which can be activated individually. Each labelling station can also consist of a plurality of units, thereby producing an individual packaging for each product comprising a plurality of labels.

The bottles can then be conveyed to a packer 129. To essentially prevent gaps in the transport of the filled and labelled bottles to this packer 129, which gaps are caused by the rejection of incorrectly filled and/or closed and/or labelled bottles, there can be buffer zones.

A central electronic control device 112, which includes a process controller can, among other things, control the operation of the above-referenced system.

In various embodiments of the present invention, the set-up table 1 can be positioned between any sequential two of the machines in the bottling system. Multiple set-up tables can be used with each set-up table positioned at different stages in the sequence.

The drive systems 150, 160 can, as discussed above, contain gear wheels or other transmission systems linking the drives 150, 160 together. Additionally, the drive systems 150, 160 can, in at least one embodiment of the present invention, include motors and associated components. The drive systems can, in at least one embodiment, be linked together by common gearing or other forms of transmission, to work in conjunction, or can possibly be separately driven.

In at least one embodiment of the present invention, the input and output star wheels can be located, for example, about 3–5 feet above the level of the floor. The drive mechanism 150, 160 for each individual star wheel can be protected by a portion of the housing. The housing portion about each individual section can have a short vertical section 9, followed by a section which is tapered significantly inward, and a column section 8. The column section 8 can be substantially straight or can be tapered inward, i.e. can have a greater diameter at the bottom of the column 8 than at the top of the column 8. The shape of the components of the housing can be adapted to fit various sizes, shapes and configurations of the associated drive machinery.

In at least one embodiment of the present invention, the column 8 can extend downward from at or substantially at the level of the star wheel 2, 3 to about one half of the distance to the floor, or possibly slightly more than one half of the distance to the floor. For example, if the star wheels 2, 3 are located 4 foot from the level of the floor, the column 8 can possibly extend from between about 1.5 and 2 feet above the floor to about 4 feet above the floor, thus having a length of about 2 to 2.5 feet. The column 8 can be substantially cylindrical or can have a taper of between about 1 to 15 degrees. Between the column 8 and the substantially vertical lower section, there can be a highly tapered section. The highly tapered section can have a vertical length of about 0.5 to 1.5 feet. The highly tapered section can have an angle of about 40 to 60 degrees. The slightly tapered or vertical section followed by the highly tapered section can be designed to cause debris, such as broken glass or spilled beverages, to slide down from the set-up table 1 and then spill off a distance away from the drive mechanism 150, 160 as it falls from the set-up table 1. This can simplify the cleaning of the area of the set-up table 1. Below the highly tapered area there can be a substantially vertical section 9 extending toward the floor. The substantially vertical section 9 can have, for example, a length of about 4 to 8 inches. The vertical section 9 can be, for example, about 4 inches to 1 foot above the level of the floor.

The clearance between the drive mechanism 150, 160 and the star wheel 2,3 can also allow for ease of repair and adjustment of the drive mechanism. The distance between the mechanisms 150, 160 and the star wheels 2, 3 can provide clearance for easier access to both the drive mechanisms 150, 160 and the star wheels 2,3 for activities such as cleaning, repair or adjustment.

One feature of the invention resides broadly in the setup table on bottle handling machines with inlet and outlet stars or star wheels or finger wheels and corresponding guide rails for the bottles, as well as drive devices for the individual stars and handling stations and a carrier or support or base plate which carrier plate covers the drive devices, characterized by the fact that in the vicinity of the bottle transport level 7, the setup table 1 comprises only the necessary bottle transport and bottle guidance devices 2–4, and the drive devices are located underneath at a significant distance from the bottle transport level 7, and these drive devices are covered in the manner of a hood, and their drive shafts are surrounded by column-like and/or tower-like housings 8 that extend to the bottle transport level 7.

Another feature of the invention resides broadly in the setup table characterized by the fact that the individual stars or star wheels and transport devices 2–4 are operated by shafts that are driven on the base side, and these shafts are surrounded by columns 8 that begin above, or start at the upper side of, the carrier plate 6.

Yet another feature of the invention resides broadly in the setup table characterized by the fact that the edge of the carrier plate 6 essentially follows the contour of the drive devices that correspond to one another.

Still another feature of the invention resides broadly in the setup table characterized by the fact that there is a sealed connection between the columns 8 and the carrier plate 6.

A further feature of the invention resides broadly in the setup table characterized by the fact that the columns 8 are conical in shape, at least in the lower portion pointing toward the carrier plate 6.

Another feature of the invention resides broadly in the setup table characterized by the fact that the columns 8 are realized in the shape of a truncated cone or a truncated pyramid.

Yet another feature of the invention resides broadly in the setup table characterized by the fact that the carrier plate 6 is realized so that it ascends diagonally and/or in a curved shape from its lower portion 9 and supports the columns 8 of the individual drive shafts.

Still another feature of the invention resides broadly in the setup table characterized by the fact that the carrier plate is realized in the form of a one-storied cast and/or welded body, and the columns 8 of the individual drives are connected to it.

A further feature of the invention resides broadly in the setup table characterized by the fact that in the upper portion of the columns 8, there are projecting star-shaped support arms 10 for the transport and bottle guidance devices 2–4.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

Examples of bottling systems, which may be used in embodiments of the present invention, may be found in the following U.S. Patents, which are hereby incorporated by reference, as if set forth in their entirety herein: U.S. Pat. No. 5,634,500, issued on Jun. 3, 1997 and entitled "Method for Bottling a Liquid in Bottles or Similar Containers"; U.S. Pat. No. 5,558,138, issued Sep. 24, 1996 and entitled "Process and Apparatus for Cleaning Container Handling Machines Such as Beverage Can Filling Machines"; and U.S. Pat. No. 5,713,403, issued Feb. 3, 1998 and entitled "Method and System for Filling Containers with a Liquid Filling Product, and Filling Machine and Labelling Device for Use with this Method or System". All of the above U.S. patent documents in this paragraph are assigned to KHS Maschinen- und Anlagenbau Aktiengesellschaft of the Federal Republic of Germany.

Examples of container labelling and/or filling machines and components thereof and/or accesories therefor may be found in the following documents, which are hereby incorporated by reference, as if set forth in their entirety herein: U.S. Pat. No. 4,944,830 issued on Jul. 31, 1990 and entitled "Machine for Labelling Bottles"; U.S. Pat. No. 4,911,285 issued on Mar. 27, 1990 and entitled "Drive for a Rotary Plate in a Labelling Machine for Bottles"; U.S. Pat. No. 4,976,803 issued on Dec. 11, 1990 and entitled "Apparatus for Pressing Foil on Containers, Such As on the Tops & the Necks of Bottles or the Like; U.S. Pat. No. 4,950,350 issued on Aug. 21, 1990 and entitled "Machine for Labelling Bottles or the Like"; U.S. Pat. No. 5,017,261 issued on May 21, 1991 and entitled "Labelling Machine for Objects Such as Bottles or the Like"; U.S. Pat. No. 5,062,917 issued on Nov. 5, 1991 and entitled "Support Element for the Followers of a Cam Drive of a Drive Mechanism & a Labelling Station Equipped With a Support Element"; U.S. Pat. No. 4,981,547 issued on Jan. 1, 1991 and entitled "Mounting & Drive Coupling for the Extracting Element Support of a Labelling Station for a Labelling Machine for Containers and Similar Objects"; U.S. Pat. No. 5,004,518 issued on Apr. 2, 1991 and entitled "Labelling Machine for Objects such as Bottles or the Like"; U.S. Pat. No. 5,078,826 issued on Jan. 7, 1992 and entitled "Labelling Machine for the Labelling of Containers"; U.S. Pat. No. 5,062,918 issued on Nov. 5, 1991 and entitled "Glue Segments which can be Attachable to a Drive Shaft of a Labelling Machine"; U.S. Pat. No. 5,227,005 and issued on Jul. 13, 1993 and entitled "Labelling Station for Labelling Objects, Such as Bottles"; U.S. Pat. No. 5,087,317 issued on Feb. 11, 1992 and entitled "Labelling Machines for the Labelling of Container"; U.S. Pat. No. 5,129,984 issued on Jul. 14, 1992 and entitled "Bottle Labelling Machine"; U.S. Pat. No. 5,185,053 issued on Feb. 9, 1993 and entitled "Brushing Station for a Labelling Machine for Labelling Bottles & the Like"; U.S. Pat. No. 5,075,123 issued on Dec. 24, 1991 and entitled "Process & Apparatus for Removing Alcohol From Beverages"; U.S. Pat. No. 5,217,538 issued on Jun. 8, 1993 and entitled "Apparatus & Related Method for the Removal of Labels & Foil Tags Adhering to Containers, in Particular, to Bottles"; U.S. Pat. No. 5,174,851 issued on Dec. 29, 1992 and entitled "Labelling Machine for Labelling Containers, Such as Bottles"; U.S. Pat. No. 5,110,402 issued on May 5, 1992 and entitled "Labelling Machine for Labelling Containers Such as Bottles Having a Labelling Box for a Stack of Labels in a Labelling Station"; U.S. Pat. No. 5,167,755 issued on Dec. 1, 1992 and entitled "Adhesive Scraper Which Can be Adjusted in Relation to an Adhesive Roller in a Labelling Machine"; U.S. Pat. No. 5,413,153 issued on May 9, 1995 and entitled "A Container Filling Machine for Filling Open-Top Containers, & A Filler Valve Therefor"; U.S. Pat. No. 5,569,353, issued on Oct. 29, 1996 and entitled "Labelling Machine & Apparatus for the Automatic Loading of the Main Magazine of a Labelling Machine, & A Supply Magazine Which Can Be Used in Such an Apparatus". All of the above U.S. patent documents in this paragraph are assigned to KHS Maschinen- und Anlagenbau Aktiengesellschaft of the Federal Republic of Germany.

Some additional examples of container filling systems, valves or methods and their components which may be incorporated in an embodiment of the present invention may be found in U.S. Pat. No. 5,425,402, issued on Jun. 20, 1995 and entitled "Bottling System with Mass Filling and Capping Arrays"; U.S. Pat. No. 5,450,882, issued on Sep. 19, 1995 and entitled "Beverage Dispensing Apparatus and Process"; U.S. Pat. No. 5,377,726, issued on Jan. 3, 1995 and entitled "Arrangement for Filling Bottles or Similar Containers"; U.S. Pat. No. 5,402,833, issued on Apr. 4, 1995 and entitled "Apparatus for Filling Bottles or Similar Containers"; and U.S. Pat. No. 5,445,194, issued on Aug. 29, 1995 and entitled "Filling Element for Filling Machines for Dispensing a Liquid Filling Material into Containers."

Some additional examples of methods and apparatuses for closing bottles and containers and their components which may be incorporated in an embodiment of the present invention may be found in U.S. Pat. No. 5,402,623, issued on Apr. 4, 1995, and entitled "Method and Apparatus for Closing Bottles"; U.S. Pat. No. 5,473,855, issued on Dec. 12, 1995 and entitled "System for Installing Closures on Containers"; U.S. Pat. No. 5,447,246, issued on Sep. 5, 1995 and entitled "Methods and Combinations for Sealing Corked Bottles"; U.S. Pat. No. 5,425,402, issued on Jun. 20, 1995 and entitled "Bottling System with Mass Filling and Capping Arrays"; U.S. Pat. No. 5,398,485, issued on Mar. 21, 1995, and entitled "Bottle Support Mechanism for a Capping Machine"; U.S. Pat. No. 5,419,094, issued on May 30, 1995 and entitled "Constant Speed Spindles for Rotary Capping Machine"; and U.S. Pat. No. 5,449,080, issued on Sep. 12, 1995 and entitled "Methods and Combinations for Sealing Corked Bottles."

Examples of rotary position sensors and rotary position indicators, components thereof, and components associated therewith, which may be utilized in accordance with the embodiments of the present invention, may be found in the following U.S. Patents: U.S. Pat. No. 4,458,893, which issued to Ruh on Jul. 10, 1984; U.S. Pat. No. 4,841,246, which issued to Juds and Beihoff on Jun. 20, 1989; U.S. Pat. No. 4,581,993, which issued to Schoneberger on Apr. 15, 1986; U.S. Pat. No. 4,360,889, which issued to Liedtke on Nov. 23, 1982; U.S. Pat. No. 5,222,457, which issued to Friedrich on Jun. 6, 1993; U.S. Pat. No. 4,899,643, which issued to Hvilsted and Pedersen on Feb. 13, 1990; U.S. Pat. No. 5,396,139, which issued to Surmely and Taghezout on Mar. 7, 1995; U.S. Pat. No. 5,419,195, which issued to Quinn on May 30, 1995; U.S. Pat. No. 5,424,632, which issued to Montagu on Jun. 13, 1995; U.S. Pat. No. 5,433,118, which issued to Castillo on Jul. 18, 1995; U.S. Pat. No. 5,442,329, which issued to Ghosh and DaSilva on Aug. 15, 1995; and U.S. Pat. No. 5,444,368, which issued to Horber on Aug. 22, 1995.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 197 40 373.5, filed on Sep. 13, 1997, having inventors Ulrich Petri and Klaus-Werner Jung, and DE-OS 197 40 373.5 and DE-PS 197 40 373.5, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A container filling machine comprising:

a filling unit to fill containers;

a closing apparatus to close containers filled by said filling unit;

a packing apparatus to pack containers filled by said filling unit;

a conveyor system to convey containers to at least one of: said filling unit, said closing apparatus and said packing apparatus;

said conveyor system being disposed to operatively transfer containers to at least one of: said filling unit, said closing apparatus and said packing apparatus;

said conveyor system comprising:

at least one star wheel; and a rail to guide bottles along said conveyor system;

said rail being disposed to guide bottles along said conveyor system;

a drive system to drive said at least one star wheel;

said drive system comprising a drive mechanism and at least one drive shaft;

said drive mechanism being connected to said at least one star wheel by said at least one drive shaft to drive said at least one star wheel;

said drive system comprising a cover;

said cover being disposed about said drive system to cover said drive mechanism and said at least one drive shaft and to minimize contamination of said drive system by spilled contents from containers being conveyed;

a floor contacting structure;

said at least one star wheel being disposed at a first vertical distance from said floor contacting structure;

said drive mechanism being disposed at a second vertical distance from said at least one star wheel, the second vertical distance being a substantial portion of the first vertical distance;

said cover being disposed and configured to extend toward said conveyor system;

said cover comprising at least one first portion, a second portion and at least one third portion;

each of said at least one third portion being disposed between a corresponding one of said at least one first portion and said second portion to support its corresponding first portion;

said at least one third portion having a first diameter adjacent its corresponding first portion;

said at least one third portion having a second diameter adjacent the second portion; and the second diameter of said at least one third portion being substantially greater than the first diameter of said at least one third portion to form a conical shape of said third portion.

2. The container filling machine according to claim 1 wherein the vertical distance between said at least one star wheel and said drive mechanism is substantially greater than the vertical distance between said drive mechanism and said floor contacting structure.

3. The container filling machine according to claim 2 wherein:

said at least one first portion of said cover is disposed about said at least one drive shaft;

said second portion of said cover is disposed about said drive mechanism; and said at least one first portion of said cover extends from said second portion of said cover to said conveyor system.

4. The container filling machine according to claim 3 wherein:

said at least one star wheel comprises at least one inlet star wheel and at least one outlet star wheel;

said at least one drive shaft comprises a corresponding drive shaft for each said at least one inlet star wheel and a corresponding drive shaft for each said at least one outlet star wheel;

said drive mechanism comprises a drive device corresponding to each said drive shaft; and said second portion of said cover is disposed about said drive devices.

5. The container filling machine according to claim 4 wherein:

said at least one first portion of said cover comprises a first portion corresponding to each of said drive shafts; and each said first portion of said cover is sealingly connected to said second portion of said cover.

6. The container filling machine according to claim 5 wherein:

each said first portion of said cover has a first diameter adjacent to said conveyor system;

each said first portion of said cover has a second diameter, the second diameter of said first portion being defined nearer said second portion of said cover than said first diameter; and the second diameter of each said first portion of said cover is greater than the corresponding first diameter of the same said first portion.

7. The container filling machine according to claim 6 wherein each said first portion of said cover has a substantially truncated conical shape.

8. The container filling machine according to claim 7 wherein:

said second portion of said cover and said at least one third portion of said cover are one of:
cast as a single piece; and
welded together; and each said at least one third portion is sealingly connected to its corresponding one of said at least one first portion.

9. The container filling machine according to claim 8 comprising:

a plurality of support arms;

said plurality of support arms being disposed on said at least one first portion of said cover; and said plurality of support arms being configured and disposed to support said at least one inlet star wheel and said at least one outlet star wheel.

10. A bottle filling and labelling machine comprising:

a filling unit to fill containers;

a closing apparatus to close bottles filled by said filling unit;

a labelling apparatus to label bottles filled by said filling unit;

a packing apparatus to pack bottles filled by said filling unit;

a set-up table to convey bottles to at least one of: said filling unit, said closing unit, said labelling unit and said packing unit;

said set-up table being disposed to operatively transfer bottles to at least one of: said filling unit, said closing unit, said labelling unit and said packing unit;

said set-up table comprising:
at least one star wheel; and
a rail to guide bottles along said set-up table;

a drive system to drive said at least one star wheel;

said drive system comprising a drive mechanism and at least one drive shaft;

said drive mechanism being connected to said at least one star wheel by said at least one drive shaft to drive said at least one star wheel;

said at least one drive shaft being disposed and configured to drive said at least one star wheel;

said drive system comprising a cover;

said cover being disposed about said drive system to cover said drive mechanism and said at least one drive shaft and to thus minimize contamination of said drive system by spilled liquid contents from bottles being conveyed or other debris;

a floor contacting structure;

said at least one star wheel being disposed at a first vertical distance from said floor contacting structure;

said drive mechanism being disposed at a second-vertical distance from said at least one star wheel, the second vertical distance being a substantial portion of the first vertical distance;

said cover being disposed and configured to extend to said set-up table;

the vertical distance between said at least one star wheel and said drive mechanism being substantially greater than the vertical distance between said drive mechanism and said floor contacting structure to provide a clearance between said at least one star wheel and said drive mechanism;

said cover comprising at least one first portion and a second portion;

said at least one first portion of said cover being disposed about said at least one drive shaft;

said second portion of said cover being disposed about said drive mechanism;

said at least one first portion of said cover extending from said second portion of said cover to said set-up table;

said at least one star wheel comprising at least one inlet star wheel and at least one outlet star wheel;

said at least one drive shaft comprising a corresponding drive shaft for each said at least one inlet star wheel and a corresponding drive shaft for each said at least one outlet star wheel;

said drive mechanism comprising a drive device corresponding to each said drive shaft;

said second portion of said cover being disposed about all of said drive devices;

said at least one first portion of said cover comprising a first portion corresponding to each of said drive shafts;

each said first portion of said cover being sealingly connected to said second portion of said cover;

each said first portion of said cover having a first diameter adjacent to said conveyor system;

each said first portion of said cover having a second diameter, the second diameter being defined nearer said second portion of said cover than said first diameter;

the second diameter of each said first portion of said cover being greater than the corresponding first diameter of the same said first portion;

each said first portion of said cover having a substantially truncated conical shape;

said cover comprising at least one third portion;

each of said at least one third portion being disposed between a corresponding one of said at least one first portion and said second portion to support its corresponding first portion;

said at least one third portion having a third diameter adjacent its corresponding first portion;

said at least one third portion having a fourth diameter adjacent the second portion; and the fourth diameter of said at least one third portion being substantially greater than the third diameter of said at least one third portion to form a conical shape of said third portion.

11. The bottle filling machine according to claim 10 wherein:

said second portion of said cover and said at least one third portion of said cover are one of:
cast as a single piece; and
welded together;

each said at least one third portion is sealingly connected to its corresponding one of said at least one first portion;

said bottle filling machine further comprising:
a plurality of support arms;
said plurality of support arms being disposed on said at least one first portion of said cover; and
said plurality of support arms being configured and disposed to support said at least one inlet star wheel and said at least one outlet star wheel.

12. A container filling machine comprising:

a filling unit to fill containers;

a closing apparatus to close containers filled by said filling unit;

a packing apparatus to pack containers filled by said filling unit;

a conveyor system to convey containers to at least one of: said filling unit, said closing apparatus and said packing apparatus;

said conveyor system being disposed to operatively transfer containers to at least one of: said filling unit, said closing apparatus and said packing apparatus;

said conveyor system comprising:
at least one star wheel; and
a rail to guide bottles along said conveyor system;

a drive system to drive said at least one star wheel;

said drive system comprising a drive mechanism and at least one drive shaft;

said drive mechanism being connected to said at least one star wheel by said at least one drive shaft to drive said at least one star wheel;

said drive system comprising a cover;

said cover being disposed about said drive system to cover said drive mechanism and said at least one drive shaft and to minimize contamination of said drive system by spilled contents from containers being conveyed;

a floor contacting structure;

said at least one star wheel being disposed at a first vertical distance from said floor contacting structure;

said drive mechanism being disposed at a second vertical distance from said at least one star wheel, the second vertical distance being a substantial portion of the first vertical distance;

said cover being disposed and configured to extend toward said conveyor system;

the vertical distance between said at least one star wheel and said drive mechanism being substantially greater than the vertical distance between said drive mechanism and said floor contacting structure;

said cover comprising at least one first portion and a second portion;

said at least one first portion of said cover being disposed about said at least one drive shaft;

said second portion of said cover being disposed about said drive mechanism;

said at least one first portion of said cover extending from said second portion of said cover to said conveyor system;

said at least one star wheel comprising at least one inlet star wheel and at least one outlet star wheel;

said at least one drive shaft comprising a corresponding drive shaft for each said at least one inlet star wheel and a corresponding drive shaft for each said at least one outlet star wheel;

said drive mechanism comprising a drive device corresponding to each said drive shaft;

said second portion of said cover being disposed about said drive devices;

said at least one first portion of said cover comprising a first portion corresponding to each of said drive shafts;

each said first portion of said cover being sealingly connected to said second portion of said cover;

each said first portion of said cover having a first diameter adjacent to said conveyor system;

each said first portion of said cover having a second diameter, the second diameter being defined nearer said second portion of said cover than said first diameter;

the second diameter of each said first portion of said cover being greater than the corresponding first diameter of the same said first portion;

each said first portion of said cover having a substantially truncated conical shape;

said cover comprising at least one third portion;

each of said at least one third portion being disposed between a corresponding one of said at least one first portion and said second portion to support its corresponding first portion;

said at least one third portion having a third diameter adjacent its corresponding first portion;

said at least one third portion having a fourth diameter adjacent the second portion; and the fourth diameter of said at least one third portion being substantially greater than the third diameter of said at least one third portion to form a conical shape of said third portion.

13. The container filling machine according to claim 12 wherein:

said second portion of said cover and said at least one third portion of said cover are one of:
cast as a single piece; and
welded together; and each said at least one third portion is sealingly connected to its corresponding one of said at least one first portion.

14. The container filling machine according to claim 13 comprising:

a plurality of support arms;

said plurality of support arms being disposed on said at least one first portion of said cover; and said plurality of support arms being configured and disposed to support said at least one inlet star wheel and said at least one outlet star wheel.

* * * * *